US011100847B2

(12) United States Patent
Choi et al.

(10) Patent No.: US 11,100,847 B2
(45) Date of Patent: Aug. 24, 2021

(54) SCAN DRIVER AND DISPLAY DEVICE INCLUDING THE SAME

(71) Applicant: Samsung Display Co., Ltd., Yongins-si (KR)

(72) Inventors: Yang Hwa Choi, Yongin-si (KR); Sun Kwang Kim, Yongin-si (KR); Sang Jin Jeon, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/781,187

(22) Filed: Feb. 4, 2020

(65) Prior Publication Data

US 2020/0258446 A1 Aug. 13, 2020

(30) Foreign Application Priority Data

Feb. 7, 2019 (KR) ..... 10-2019-0014603

(51) Int. Cl.
*G09G 3/32* (2016.01)

(52) U.S. Cl.
CPC ..... *G09G 3/32* (2013.01); *G09G 2300/0408* (2013.01); *G09G 2310/0278* (2013.01); *G09G 2310/0294* (2013.01); *G09G 2310/08* (2013.01)

(58) Field of Classification Search
CPC ..... G09G 3/32; G09G 2300/0408; G09G 2310/0278; G09G 2310/0294; G09G 2310/08
See application file for complete search history.

(56) References Cited

U.S. PATENT DOCUMENTS

| | | | | |
|---|---|---|---|---|
| 9,942,251 | B1 | 4/2018 | Wang et al. | |
| 2016/0217742 | A1* | 7/2016 | Tanikame | G09G 3/3291 |
| 2020/0184898 | A1 | 6/2020 | Choi et al. | |
| 2020/0193912 | A1 | 6/2020 | Park et al. | |
| 2020/0202761 | A1 | 6/2020 | Choi et al. | |

FOREIGN PATENT DOCUMENTS

| | | |
|---|---|---|
| KR | 10-2016-0073928 | 6/2016 |
| KR | 10-2018-0031879 | 3/2018 |
| KR | 10-2020-0071206 | 6/2020 |
| KR | 10-2020-0072635 | 6/2020 |
| KR | 10-2020-0077665 | 7/2020 |
| KR | 10-2020-0083763 | 7/2020 |
| KR | 10-2020-0100247 | 8/2020 |

* cited by examiner

*Primary Examiner* — Wing H Chow
(74) *Attorney, Agent, or Firm* — H.C. Park & Associates, PLC

(57) ABSTRACT

A scan driver includes two or more scan signal output circuits (SSOC), each being coupled to a first scan line (FSL) and a second scan line (SSL), and including a driving circuit, a first buffer circuit (FBC), and a second buffer circuit (SBC). The driving circuit applies a first driving signal (DS) to a first driving node (DN) and applies a second DS to a second DN based on an input signal, a clock signal (CS), a display-on signal, and an on-level voltage. The input signal is a scan start signal or a previous scan signal. The FBC outputs a sensing signal to the SSL based on the first DS, the second DS, an off-level voltage, and a sensing CS. The SBC outputs a scan signal to the FSL based on the first DS, the second DS, the off-level voltage, and a scan CS.

26 Claims, 10 Drawing Sheets

SCAN DRIVER AND DISPLAY DEVICE INCLUDING THE SAME

CROSS-REFERENCE TO RELATED APPLICATION

This application claims priority from and the benefit of Korean Patent Application No. 10-2019-0014603, filed Feb. 7, 2019, which is hereby incorporated by reference for all purposes as if fully set forth herein.

BACKGROUND

Field

Exemplary embodiments generally relate to a scan driver and a display device including the scan driver.

Discussion

Generally, a display device may include a display panel, a scan driver, a data driver, a timing controller, etc. The scan driver may provide scan signals (which may be composed of a scan-on signal and a scan-off signal) to the display panel through scan lines. For this operation, the scan driver may include and operate scan signal output circuits that are sequentially coupled to each other and are each composed of oxide thin-film transistors.

Some display devices may compensate for deterioration of a pixel or a change in the characteristics of the pixel (e.g., a characteristic change depending on temperature or the like) by sensing mobility information of a driving transistor included in a pixel circuit or deterioration information of a light-emitting element. In this case, the scan driver may generate and output scan signals for a display operation, a mobility sensing operation, and an operation of sensing the deterioration of a light-emitting element.

The above information disclosed in this section is only for understanding the background of the inventive concepts, and, therefore, may contain information that does not form prior art.

SUMMARY

Some exemplary embodiments are directed to a scan driver capable of accurately sensing mobility and deterioration of a light-emitting element, such as when a display device is in a powered-on state.

Additional aspects will be set forth in the detailed description which follows, and, in part, will be apparent from the disclosure, or may be learned by practice of the inventive concepts.

According to some exemplary embodiments, a scan driver includes first to n-th scan signal output circuits, "n" being a natural number of two (2) or more. Each of the first to n-th scan signal output circuits is coupled to a first scan line and a second scan line. Each of the first to n-th scan signal output circuits includes a driving circuit, a first buffer circuit, and a second buffer circuit. The driving circuit is configured to apply a first driving signal to a first driving node and apply a second driving signal to a second driving node based on an input signal, a clock signal, a display-on signal, and an on-level voltage. The input signal is one of a scan start signal and a previous scan signal. The first buffer circuit is configured to output a sensing signal to the second scan line based on the first driving signal, the second driving signal, an off-level voltage, and a sensing clock signal. The second buffer circuit is configured to output a scan signal to the first scan line based on the first driving signal, the second driving signal, the off-level voltage, and a scan clock signal.

According to some exemplary embodiments, a display device includes a display unit, a data driver, a scan driver, and a timing controller. The display unit includes pixels. The data driver is configured to supply a data signal to the display unit. The scan driver is configured to supply a scan signal and a sensing signal to the display unit. The timing controller is configured to control the data driver and the scan driver. The scan driver includes first to n-th ("n" being is a natural number of two (2) or more) scan signal output circuits. Each of the first to n-th scan signal output circuits being coupled to a first scan line and a second scan line. Each of the first to n-th scan signal output circuits includes a driving circuit, a first buffer circuit, and a second buffer circuit. The driving circuit is configured to apply a first driving signal to a first driving node and apply a second driving signal to a second driving node based on an input signal, a clock signal, a display-on signal, and an on-level voltage. The input signal is one of a scan start signal and a previous scan signal. The first buffer circuit is configured to output a sensing signal to the second scan line based on the first driving signal, the second driving signal, an off-level voltage, and a sensing clock signal. The second buffer circuit is configured to output a scan signal to the first scan line based on the first driving signal, the second driving signal, the off-level voltage, and a scan clock signal.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION OF SOME EXEMPLARY EMBODIMENTS

Figure 1:
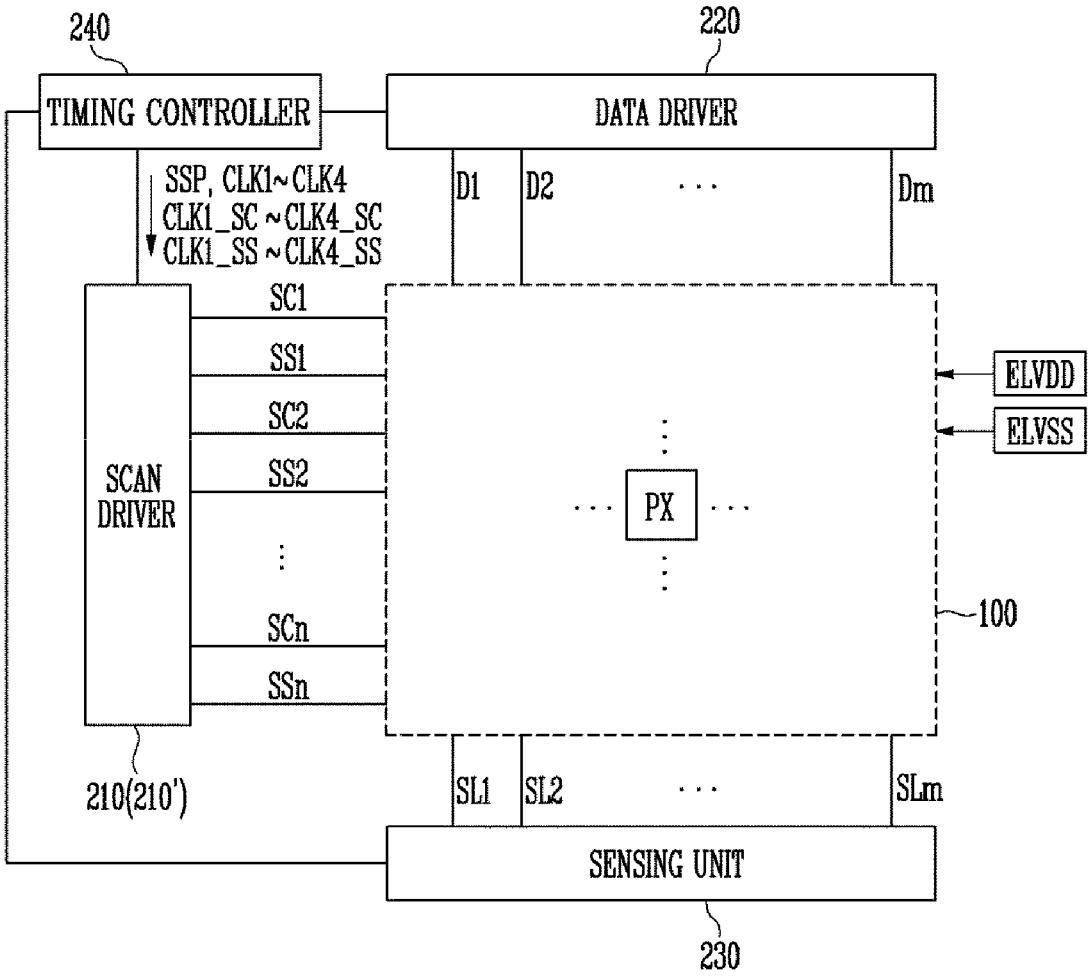
FIG. 1 is a block diagram illustrating the configuration of a display device according to some exemplary embodiments.

In the following description, for the purposes of explanation, numerous specific details are set forth in order to provide a thorough understanding of various exemplary embodiments. As used herein, the terms "embodiments" and "implementations" are used interchangeably and are non-limiting examples employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some exemplary embodiments. Therefore, unless otherwise specified, the features, components, modules, layers, films, panels, regions, aspects, etc. (hereinafter individually or collectively referred to as an "element" or "elements"), of the various illustrations may be otherwise combined, separated, interchanged, and/or rearranged without departing from the inventive concepts.

In the accompanying drawings, the size and relative sizes of elements may be exaggerated for clarity and/or descriptive purposes. As such, the sizes and relative sizes of the respective elements are not necessarily limited to the sizes and relative sizes shown in the drawings. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. Other terms and/or phrases used to describe a relationship between elements should be interpreted in a like fashion, e.g., "between" versus "directly between," "adjacent" versus "directly adjacent," "on" versus "directly on," etc. Further, the term "connected" may refer to physical, electrical, and/or fluid connection. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one element's relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the inventive concepts. Further, the blocks, units, and/or modules of some exemplary embodiments may be physically combined into more complex blocks, units, and/or modules without departing from the inventive concepts.

Hereinafter, various exemplary embodiments will be explained in detail with reference to the accompanying drawings.

FIG. 1 is a diagram illustrating the configuration of a display device according to some exemplary embodiments.

Referring to FIG. 1, the display device according to some exemplary embodiments may include a display unit 100 including a plurality of pixels PX, a scan driver 210, a data driver 220, a sensing unit 230, and a timing controller 240.

The timing controller 240 may generate a scan driving control signal and a data driving control signal based on input signals, e.g., externally input signals. The scan driving control signal generated by the timing controller 240 may be supplied to the scan driver 210, and the data driving control signal may be supplied to the data driver 220.

The scan driving control signal may include a plurality of clock signals CLK1 to CLK4, CLK1_SC to CLK4_SC, and CLK1_SS to CLK4_SS and a scan start signal SSP. The scan start signal SSP may control the output timing of a first scan signal.

The plurality of clock signals CLK1 to CLK4, CLK1_SC to CLK4_SC, and CLK1_SS to CLK4_SS, which are supplied to the scan driver 210, may include the first to fourth clock signals CLK1 to CLK4, the first to fourth scan clock signals CLK1_SC to CLK4_SC, and the first to fourth sensing clock signals CLK1_SS to CLK4_SS. The first to fourth clock signals CLK1 to CLK4 may be used to shift the scan start signal SSP. Each of the first to fourth scan clock signals CLK1_SC to CLK4_SC may be used to output a scan signal in response to the scan start signal SSP and at least one of the first to fourth clock signals CLK1 to CLK4. Each of the first to fourth sensing clock signals CLK1_SS to CLK4_SS may be used to output a sensing signal in response to the scan start signal SSP and at least one of the first to fourth clock signals CLK1 to CLK4. The scan driver 210 may further receive additional clock signals in addition to the aforementioned clock signals CLK1 to CLK4, CLK1_SC to CLK4_SC, and CLK1_SS to CLK4_SS.

In some exemplary embodiments, the data driving control signal may include a source start pulse and clock signals. The source start pulse may control the sampling start time point of data, and the clock signals may be used to control a sampling operation.

The scan driver 210 may output scan signals in response to the scan driving control signal. The scan driver 210 may sequentially supply the scan signals to first scan lines SC1 to SCn, "n" being a natural number. The scan signals may be set to gate-on voltages (e.g., high-level voltages) so that transistors included in the pixels PX can be turned on.

The scan driver 210 may output sensing signals in response to the scan driving control signal. The scan driver 210 may supply a sensing signal to at least one of second scan lines SS1 to SSn. Here, sensing signals may be set to gate-on voltages (e.g., high-level voltages) so that the transistors included in the pixels PX can be turned on.

The data driver 220 may supply data signals to data lines D1 to Dm in response to the data driving control signal, "m" being a natural number. The data signals supplied to the data lines D1 to Dm may be provided to the pixels PX to which scan signals are supplied. For this operation, the data driver 220 may supply the data signals to the data lines D1 to Dm in synchronization with the scan signals.

The sensing unit 230 may supply initialization power to the pixels, to which the sensing signals are supplied, through sensing lines SL1 to SLm, and may measure (or otherwise determine) information about deterioration of the pixels. Although the sensing unit 230 is illustrated as being a separate component in FIG. 1, the sensing unit 230 may also be included in the data driver 220 or any other suitable component of the display device.

The display unit 100 may include a plurality of pixels PX coupled to the data lines D1 to Dm, the first scan lines SC1 to SCn, the second scan lines SS1 to SSn, and the sensing lines SL1 to SLm. The pixels PX may be supplied with first power ELVDD and second power ELVSS from an external device.

The respective pixels PX may be supplied with data signals from the data lines D1 to Dm when or in response to scan signals being supplied to the first scan lines SC1 to SCn coupled to the corresponding pixels PX. Each pixel PX supplied with the corresponding data signal may control, in response to the data signal, the amount of current flowing from the first power ELVDD to the second power ELVSS via a light-emitting element (not illustrated). The light-emitting element may generate light with predetermined luminance depending on the amount of current. In addition, the voltage of the first power ELVDD may be set to a voltage higher than that of the second power ELVSS.

Although, in FIG. 1, each pixel PX is illustrated as being coupled to a single first scan line SCi and a single data line Dj, exemplary embodiments are not limited thereto. For instance, depending on the circuit structure of the pixel PX, a plurality of first scan lines SC1 to SCn may be coupled to the pixel PX. Furthermore, in some cases, respective pixels PX may be further coupled to emission control lines (not shown) in addition to the first scan lines SC1 to SCn and the data lines D1 to Dm. In this case, the display device may further include an emission driver configured to output the emission control signals.

Figure 2:
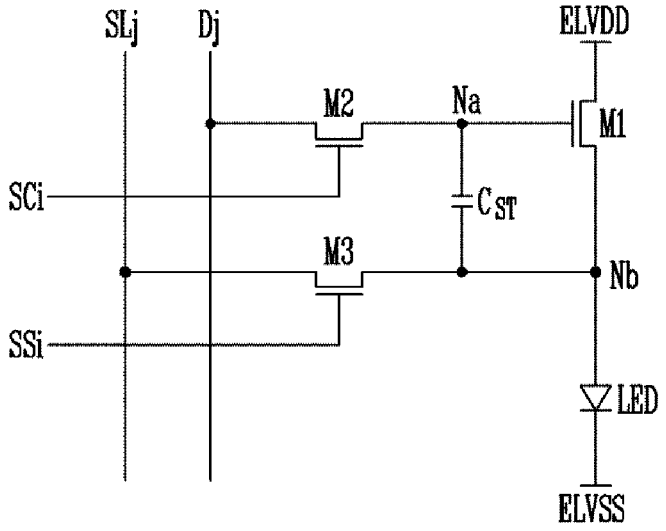
FIG. 2 is a diagram illustrating the structure of a pixel illustrated in FIG. 1 according to some exemplary embodiments.

FIG. 2 is a diagram illustrating the structure of a pixel illustrated in FIG. 1 according to some exemplary embodiments. In FIG. 2, a pixel PX coupled to an i-th first scan line SCi and a j-th data line Dj is illustrated for convenience of description, "i" being a natural number less than or equal to "n" and "j" being a natural number less than or equal to "m."

The pixel PX may include a driving transistor M1, a switching transistor M2, a sensing transistor M3, a storage capacitor Cst, and a light-emitting element (e.g., a light-emitting diode, such as an organic light-emitting diode) LED.

The switching transistor M2 may include a first electrode coupled to the j-th data line Dj, a gate electrode coupled to the i-th first scan line SCi, and a second electrode coupled to a first node Na. When a scan signal is supplied from the i-th first scan line SCi, the switching transistor M2 is turned on, and may then supply a data signal received from the j-th data line Dj to the storage capacitor Cst. Alternatively, the switching transistor M2 may control the potential of the first node Na.

The storage capacitor Cst including a first electrode coupled to the first node Na and a second electrode coupled to a second node Nb may charge a voltage corresponding to the data signal.

The driving transistor M1 may include a first electrode coupled to first power ELVDD, a second electrode coupled to the light-emitting element LED, and a gate electrode coupled to the first node Na. The driving transistor M1 may control the amount of current flowing through the light-emitting element LED according to a gate-source voltage of the driving transistor M1.

The sensing transistor M3 may include a first electrode coupled to a j-th sensing line SLj, a second electrode coupled to the second node Nb, and a gate electrode coupled to an i-th second scan line SSi. When a sensing signal is supplied to the i-th second scan line SSi, the sensing transistor M3 may be turned on to control the potential of the second node Nb. Alternatively, when a sensing signal is supplied to the i-th second scan line SSi, the sensing transistor M3 may be turned on, and then current flowing through the light-emitting element LED may be measured.

The light-emitting element LED may include a first electrode (e.g., an anode electrode) coupled to the second electrode of the driving transistor M1 and a second electrode (e.g., a cathode electrode) coupled to the second power ELVSS. The light-emitting element LED may generate light corresponding to the amount of current supplied from the driving transistor M1.

In FIG. 2, the first electrode of each of the transistors M1 to M3 may be set to one of a source electrode and a drain electrode, and the second electrode of each of the transistors M1 to M3 may be set to the remaining electrode different from the first electrode. For example, when the first electrode is set to a source electrode, the second electrode may be set to a drain electrode.

Also, as illustrated in FIG. 2, the transistors M1 to M3 may be n-type metal-oxide-semiconductor (NMOS) transistors, but exemplary embodiments are not limited thereto.

During sensation of the mobility of the driving transistor M1, an activated scan signal is supplied to the first scan line SCi, and an activated sensing signal is supplied to the second scan line SSi. However, to sense the current flowing through the light-emitting element LED and acquire deterioration information, the driving transistor M1 should be turned off and the sensing transistor M3 should be turned on. That is, while the current flowing through the light-emitting element LED is sensed, an inactivated signal should be applied to the first scan line SCi and an activated signal should be applied to the second scan line SSi. Therefore, the scan signal to be supplied to the first scan line SCi and the sensing signal to be supplied to the second scan line SSi may be separately supplied via the first scan line SCi and the second scan line SSi, respectively.

Figure 3:
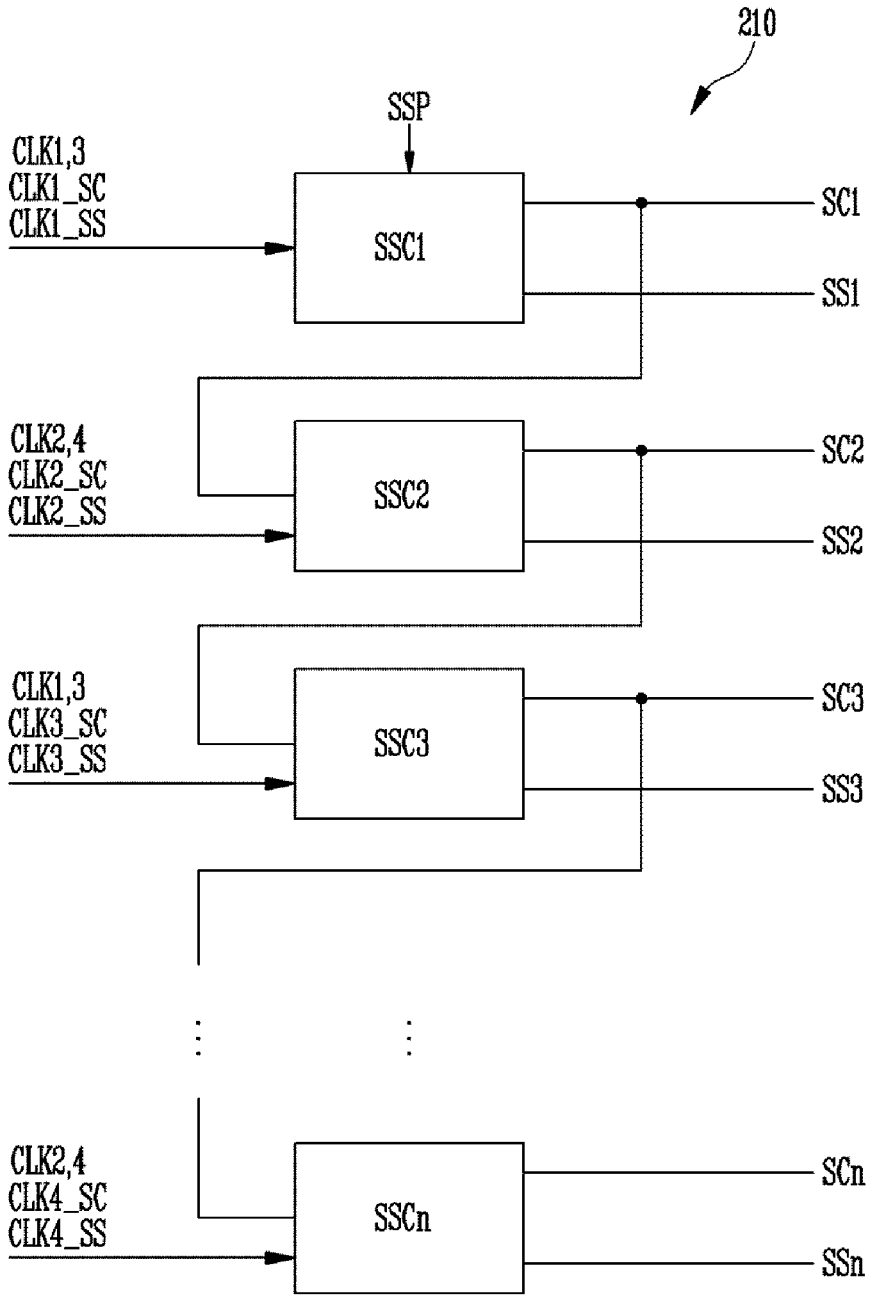
FIG. 3 is a diagram illustrating the configuration of a scan driver according to some exemplary embodiments.

FIG. 3 is a diagram illustrating the configuration of a scan driver according to some exemplary embodiments.

Referring to FIG. 3, the scan driver 210 may include a plurality of scan signal output circuits SSC1 to SSCn. The scan driver 210 may supply scan signals to the first scan lines SC1 to SCn so that a display device can display an image. Further, the scan driver 210 may supply sensing signals to the second scan lines SS1 to SSn so that the display device can perform an operation of sensing mobility and an operation of sensing the deterioration of a light-emitting element LED.

The scan signal output circuits SSC1 to SSCn may be sequentially coupled to each other, and a single first scan line and a single second scan line may be coupled to each of the scan signal output circuit SSC1 to SSCn. Each of the scan signal output circuits SSC1 to SSCn may receive at least two of first to fourth clock signals CLK1 to CLK4, receive at least one of first to fourth scan clock signals CLK1_SC to CLK4_SC, and receive at least one of first to fourth sensing clock signals CLK1_SS to CLK4_SS.

The first scan signal output circuit SSC1 may receive the first and third clock signals CLK1 and CLK3, the first scan clock signal CLK1_SC, the first sensing clock signal CLK1_SS, and a scan start signal SSP. The first scan signal output circuit SSC1 may be coupled to the first scan line SC1 and the first second scan line SS1. The second scan signal output circuit SSC2 may be coupled to the first scan signal output circuit SSC1 to receive a scan signal output from the first scan signal output circuit SSC1, and may receive the second and fourth clock signals CLK2 and CLK4, the second scan clock signal CLK2_SC, and the second sensing clock signal CLK2_SS. Also, the second scan signal output circuit SSC2 may be coupled to the second first scan line SC2 and the second scan line SS2. Also, the n-th scan signal output circuit SSCn may be coupled to the (n−1)-th scan signal output circuit SSCn-1 to receive a scan signal output from the (n−1)-th scan signal output circuit SSCn-1, and may receive the second and fourth clock signals CLK2 and CLK4, the fourth scan clock signal CLK4_SC, and the fourth sensing clock signal CLK4_SS. Further, the n-th scan signal output circuit SSCn may be coupled to the n-th first scan line SCn and the n-th second scan line SSn.

When the display device performs the operation of displaying an image, the scan driver 210 may sequentially apply scan signals to the first to n-th first scan lines SC1 to SCn in response to the scan start signal SSP. For example, after the first scan signal output circuit SSC1 has output a scan signal, the second scan signal output circuit SSC2 may output a scan signal. After the second scan signal output circuit SSC2 has output the scan signal, the third scan signal output circuit SSC3 may output a scan signal. After the n−1-th scan signal output circuit SSCn-1 has output a scan signal, the n-th scan signal output circuit SSCn may output a scan signal.

When the display device performs the operation of sensing mobility or the deterioration of the light-emitting element LED, the scan driver 210 may select a sensing target scan line on which the sensing operation is to be performed, and may output the sensing signal to the selected sensing target scan line.

In various exemplary embodiments, the scan driver 210 may sequentially apply the scan signals to the first scan lines SC1 to SCn during a display period of one frame, and may apply a sensing signal to at least one of the second scan lines SS1 to SSn during a porch period of the one frame.

Figure 4:
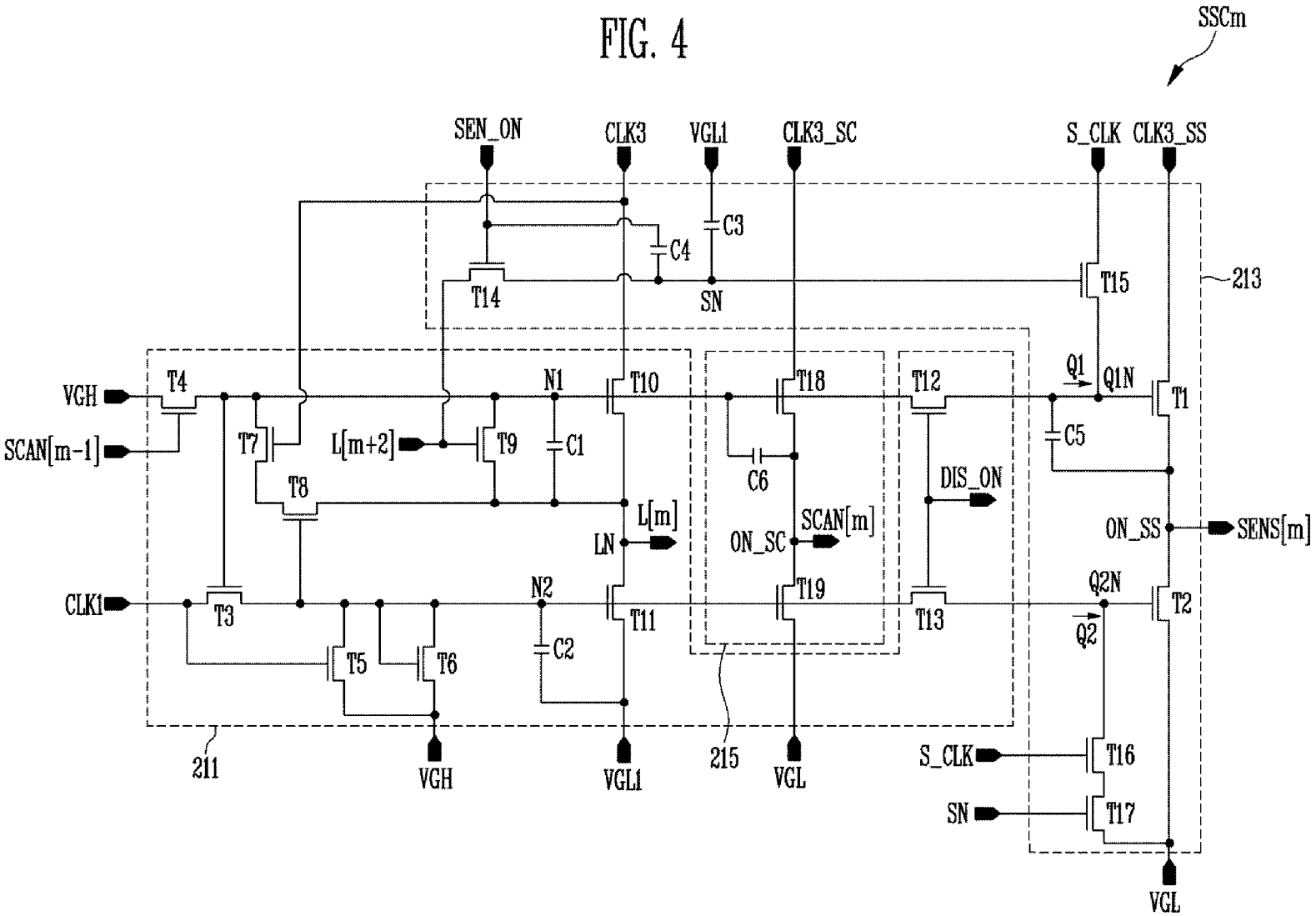
FIG. 4 is a diagram illustrating the configuration of any one of scan signal output circuits illustrated in FIG. 3 according to some exemplary embodiments.

FIG. 4 is a diagram illustrating the configuration of any one of scan signal output circuits illustrated in FIG. 3 according to some exemplary embodiments. In FIG. 4, the configuration of an m-th scan signal output circuit SSCm is illustrated for convenience of description.

Referring to FIG. 4, the m-th scan signal output circuit SSCm may include a driving circuit 211, a first buffer circuit 213, and a second buffer circuit 215.

The driving circuit 211 may include third to thirteenth transistors T3 to T13 and first and second capacitors C1 and C2.

The third transistor T3 may include a first electrode configured to receive a first clock signal CLK1, a second electrode coupled to a second node N2, and a gate electrode coupled to a first node N1.

The fourth transistor T4 may include a first electrode coupled to an on-level voltage VGH, a second electrode coupled to the first node N1, and a gate electrode configured to receive an (m−1)-th scan signal SCAN[m−1] that is an input signal. Although a configuration in which the (m−1)-th scan signal SCAN [m−1] is input to the gate electrode of the fourth transistor T4 is illustrated in FIG. 4, a scan start signal SSP may be input as an input signal to the gate electrode of the fourth transistor T4 included in a first scan signal output circuit SSC1.

The fifth transistor T5 may include a first electrode coupled to the second node N2, a second electrode coupled to the on-level voltage VGH, and a gate electrode configured to receive the first clock signal CLK1.

The sixth transistor T6 may include a first electrode coupled to the second node N2, a second electrode coupled to the on-level voltage VGH, and a gate electrode coupled to the second node N2.

The seventh transistor T7 may include a first electrode coupled to the first node N1, a second electrode coupled to a first electrode of the eighth transistor T8, and a gate electrode configured to receive a third clock signal CLK3.

The eighth transistor T8 may include a first electrode coupled to the second electrode of the seventh transistor T7, a second electrode coupled to a carry signal output node LN, and a gate electrode coupled to the second node N2.

The ninth transistor T9 may include a first electrode coupled to the first node N1, a second electrode coupled to the carry signal output node LN, and a gate electrode configured to receive a next carry signal L[m+2]. Although, in FIG. 4, the next carry signal L[m+2] is illustrated as being a carry signal output from an (m+2)-th scan signal output circuit SSCm+2, the next carry signal L[m+2] may be a carry signal output from an additional scan signal output circuit in accordance with an exemplary embodiment.

The first capacitor C1 may include a first electrode coupled to the first node N1 and a second electrode coupled to the carry signal output node LN.

The tenth transistor T10 may include a first electrode configured to receive the third clock signal CLK3, a second electrode coupled to the carry signal output node LN, and a gate electrode coupled to the first node N1.

The eleventh transistor T11 may include a first electrode coupled to the carry signal output node LN, a second electrode coupled to a sub-off-level voltage VGL1 having a voltage level lower than that of an off-level voltage VGL, and a gate electrode coupled to the second node N2.

The second capacitor C2 may include a first electrode coupled to the second node N2 and a second electrode coupled to the sub-off-level voltage VGL1.

The twelfth transistor T12 may include a first electrode coupled to the first node N1, a second electrode coupled to a first driving node Q1N, and a gate electrode configured to receive a display-on signal DIS_ON.

The thirteenth transistor T13 may include a first electrode coupled to the second node N2, a second electrode coupled to a second driving node Q2N, and a gate electrode configured to receive the display-on signal DIS_ON.

The first buffer circuit 213 may include a first transistor T1, a second transistor T2, fourteenth to seventeenth transistors T14 to T17, and third to fifth capacitors C3 to C5.

The fourteenth transistor T14 may include a first electrode configured to receive the next carry signal L[m+2], a second electrode coupled to a sampling node SN, and a gate electrode configured to receive a sensing-on signal SEN_ON.

The third capacitor C3 may include a first electrode coupled to the sampling node SN and a second electrode coupled to the sub-off-level voltage VGL1. In accordance with some exemplary embodiments, the second electrode of the third capacitor C3 may be coupled to the off-level voltage VGL.

The fourth capacitor C4 may include a first electrode coupled to the sampling node SN and a second electrode coupled to the gate electrode of the fourteenth transistor T14 that receives the sensing-on signal SEN_ON.

The fifteenth transistor T15 may include a first electrode configured to receive a sensing mode enable clock signal S_CLK, a second electrode coupled to the first driving node Q1N, and a gate electrode coupled to the sampling node SN.

The sixteenth transistor T16 may include a first electrode coupled to the second driving node Q2N, a second electrode coupled to a first electrode of the seventeenth transistor T17, and a gate electrode configured to receive the sensing mode enable clock signal S_CLK.

The seventeenth transistor T17 may include a first electrode coupled to the second electrode of the sixteenth transistor T16, a second electrode coupled to the off-level voltage VGL, and a gate electrode coupled to the sampling node SN.

The first transistor T1 may include a first electrode configured to receive a third sensing clock signal CLK3_SS, a second electrode coupled to a sensing signal output node ON_SS, and a gate electrode coupled to the first driving node Q1N.

The second transistor T2 may include a first electrode coupled to the sensing signal output node ON_SS, a second electrode coupled to the off-level voltage VGL, and a gate electrode coupled to the second driving node Q2N.

In accordance with some exemplary embodiments, the first buffer circuit 213 may further include a capacitor including a first electrode configured to receive the sensing-on signal SEN_ON and a second electrode coupled to the sampling node SN. Further, in accordance with some exemplary embodiments, the first buffer circuit 213 may further include a capacitor including a first electrode coupled to the second driving node Q2N and a second electrode is coupled to the off-level voltage VGL.

The second buffer circuit 215 may include an eighteenth transistor T18, a nineteenth transistor T19, and a sixth capacitor C6.

The eighteenth transistor T18 may include a first electrode configured to receive a third scan clock signal CLK3_SC, a second electrode coupled to the scan signal output node ON_SC, and a gate electrode coupled to the first node N1.

The nineteenth transistor T19 may include a first electrode coupled to the scan signal output node ON_SC, a second electrode coupled to the off-level voltage VGL, and a gate electrode coupled to the second node N2.

The sixth capacitor C6 may include a first electrode coupled to the first node N1 and a second electrode coupled to the scan signal output node ON_SC.

According to various exemplary embodiments, each of the scan signal output circuits SSC1 to SSCn may receive a plurality of clock signals, a scan clock signal, and a sensing clock signal, and may output a scan signal and a sensing signal based on the received clock signals.

For example, the m-th scan signal output circuit SSCm may receive the first clock signal CLK1, the third clock signal CLK3, the third scan clock signal CLK3_SC, and the third sensing clock signal CLK3_SS.

A rising edge of the third clock signal CLK3 may be disposed adjacent to a falling edge of the first clock signal CLK1, a rising edge of the first clock signal CLK1 may be disposed adjacent to a falling edge of the third clock signal CLK3, and an active interval of the first clock signal CLK1 and an active interval of the third clock signal CLK3 may not overlap each other.

When the display device is in a powered-on state, one frame may include a display period and a porch period. During the display period, the display-on signal DIS_ON may be activated, and the sensing mode enable clock signal S_CLK may be inactivated, and during the inactive interval of the display-on signal DIS_ON within the porch period, the sensing mode enable clock signal S_CLK may be activated.

Furthermore, during an active interval of the next carry signal L[m+2] within the display period, the sensing-on signal SEN_ON may be activated or inactivated. For example, when the sensing-on signal SEN_ON is activated during an active interval of the next carry signal L[m+2] within the display period, a sampling voltage may be stored at the sampling node SN of the m-th scan signal output circuit SSCm, whereas when the sensing-on signal SEN_ON is not activated during the active interval of the next carry signal L[m+2] within the display period, a sampling voltage may not be stored in the m-th scan signal output circuit SSCm.

Figure 5:
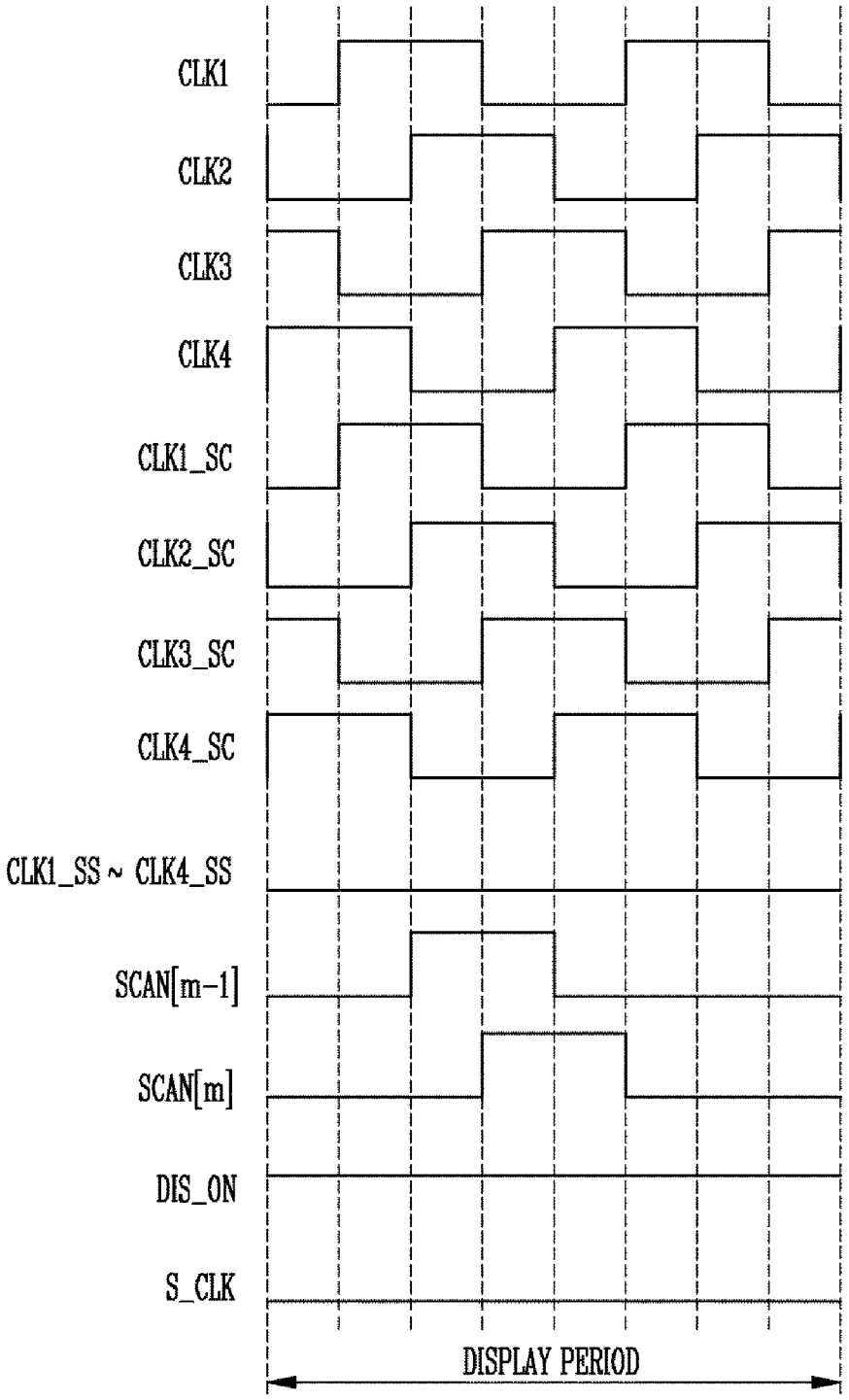
FIG. 5 is a waveform diagram for explaining an operation in which the scan signal output circuit of FIG. 4 generates a scan signal for a display operation according to some exemplary embodiments.

FIG. 5 is a waveform diagram for explaining an operation in which the scan signal output circuit of FIG. 4 generates a scan signal for a display operation according to some exemplary embodiments.

Although first to fourth clock signals CLK1 to CLK4 are illustrated in FIG. 5, a description will be made with the assumption that the m-th scan signal output circuit SSCm receives the first clock signal CLK1 and the third clock signal CLK3. In this case, an (m+1)-th scan signal output circuit SSCm+1 may receive the second clock signal CLK2 and the fourth clock signal CLK4.

Referring to FIG. 5, during a display period of one frame, a sensing mode enable clock signal S_CLK may be maintained in an inactive state (i.e., a logic low level), and a display-on signal DIS_ON may be maintained in an active state (i.e., a logic high level).

When an (m−1)-th scan signal SCAN[m−1] is input and the fourth transistor T4 is turned on, the first node N1 and the first driving node Q1N are charged to the on-level voltage VGH, and, thus, a signal applied to the first node N1 and a first driving signal Q1 applied to the first driving node Q1N may have the on-level voltage VGH.

When the (m−1)-th scan signal SCAN[m−1] is input, and then the fourth transistor T4 is turned on, the second node N2 and the second driving node Q2N are discharged to the inactive voltage of the first clock signal CLK1 in response to the inactivated first clock signal CLK1, and, thus, a signal applied to the second node N2 and a second driving signal Q2 applied to the second driving node Q2N may have the inactive voltage of the first clock signal CLK1.

As a result, the eighteenth transistor T18 and the tenth transistor T10 may be turned on, and the nineteenth transistor T19 and the eleventh transistor T11 may be turned off.

Therefore, as the third scan clock signal CLK3_SC is activated, a scan signal SCAN[m], that is, a scan-on signal, having the active voltage of the third scan clock signal CLK3_SC may be output through the scan signal output node ON_SC. Also, as the third clock signal CLK3 is activated, a carry signal L[m] having the active voltage of the third clock signal CLK3 may be output through the carry signal output node LN.

Thereafter, as the third scan clock signal CLK3_SC is inactivated again, a scan-off signal having the inactive voltage of the third scan clock signal CLK3_SC may be output through the scan signal output node ON_SC. Further, as the third clock signal CLK3 is inactivated again, the carry signal L[m] having the inactive voltage of the third clock signal CLK3 may be output through the carry signal output node LN.

According to various exemplary embodiments, when the (m−1)-th scan signal SCAN[m−1] is input, and then the fourth transistor T4 is turned on, the first driving node Q1N is charged to the on-level voltage VGH, and, thus, the first transistor T1 may also be turned on. However, during the display period, the third sensing clock signal CLK3_SS having an inactive voltage may be supplied so that a sensing-on signal is not output. In this case, the remaining sensing clock signals CLK1_SS, CLK2_SS, and CLK4_SS that are supplied to other scan signal output circuits may also be maintained in an inactive state. In this way, the scan signal output circuits SSC1 to SSCn, which are sequentially coupled to each other, may sequentially output scan signals having active voltages during the display period of one frame of the display device.

Figure 6:
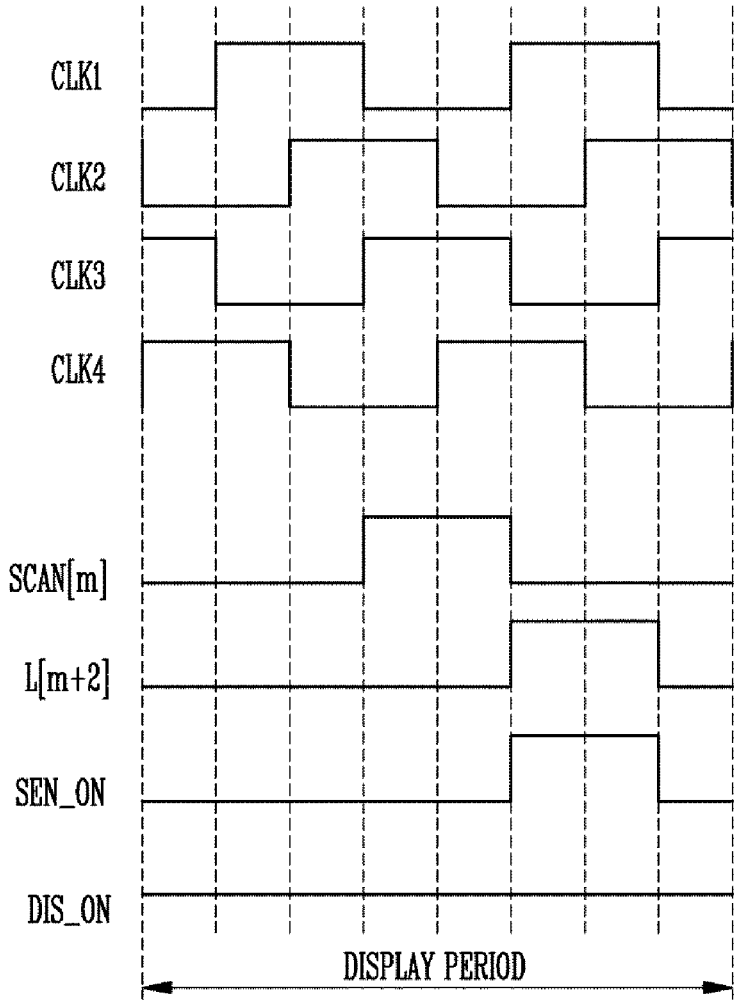
FIG. 6 is a waveform diagram for explaining an operation in which the scan signal output circuit selects a sensing target scan line that is a target of a sensing operation according to some exemplary embodiments.

FIG. 6 is a waveform diagram for explaining an operation in which the scan signal output circuit selects a sensing target scan line that is the target of a sensing operation according to some exemplary embodiments.

Referring to FIG. 6, when the first clock signal CLK1 is activated, the second node N2 is charged to an on-level voltage VGH, and, thus, the eleventh transistor T11 is turned on. When a next carry signal L[m+2] is activated, a sub-off-level voltage VGL1 may reset the first node N1 and the first driving node Q1N via the eleventh transistor T11 and the ninth transistor T9.

Thereafter, as the sensing-on signal SEN_ON is activated in a state in which the next carry signal L[m+2] is activated, the fourteenth transistor T14 is turned on, and, thus, the sampling node SN may be charged to the active voltage of the next carry signal L[m+2]. As a result, the sampling node SN may store and hold the sampling voltage using the third capacitor C3. That is, the sensing-on signal SEN_ON may be activated only for the scan signal output circuit coupled to the scan line selected as the sensing target, among the plurality of scan signal output circuits SSC1 to SSCn.

Although the next carry signal L[m+2] is illustrated as being a carry signal output from an (m+2)-th scan signal output circuit SSCm+2, the next carry signal L[m+2] may be a carry signal output from an additional scan signal output circuit in accordance with an exemplary embodiment. Furthermore, since the operation of selecting the sensing target scan line is performed during the display period, the sensing mode enable clock signal S_CLK and sensing clock signals CLK1_SS to CLK4_SS may be maintained in an inactive state.

Figure 7:
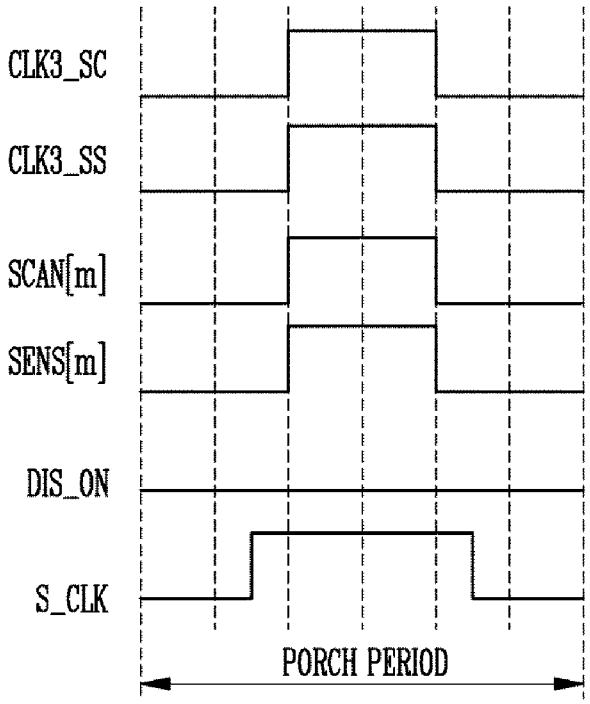
FIG. 7 is a waveform diagram for explaining an operation in which the scan signal output circuit generates a sensing signal for a mobility sensing operation according to some exemplary embodiments.

FIG. 7 is a waveform diagram for explaining an operation in which the scan signal output circuit generates a sensing signal for a mobility sensing operation according to some exemplary embodiments.

Referring to FIG. 7, during a porch period of one frame, the fifteenth transistor T15 in the scan signal output circuit SSCm, in which the sampling node SN holds the sampling voltage using the third capacitor C3, may be turned on by a sampling voltage.

When the sensing mode enable clock signal S_CLK is activated in a state in which the fifteenth transistor T15 is in a turned-on state, the first driving node Q1N may be charged to the active voltage of the sensing mode enable clock signal S_CLK.

Accordingly, the first driving signal Q1 applied to the first driving node Q1N may have the active voltage of the sensing mode enable clock signal S_CLK. As a result, the first transistor T1 may be turned on, and the sensing signal SENS[m] having the active voltage of the third sensing clock signal CLK3_SS may be output through the sensing signal output node ON_SS. At this time, the remaining sensing clock signals CLK1_SS, CLK2_SS, and CLK4_SS other than the third sensing clock signal CLK3_SS may have inactive voltages, but exemplary embodiments are not limited thereto, and the remaining sensing clock signals CLK1_SS, CLK2_SS, and CLK4_SS may also have active voltages.

Meanwhile, while the display-on signal DIS_ON is inactivated during the porch period, the twelfth transistor T12 and the thirteenth transistor T13 are turned off, and the first driving node Q1N is charged to the active voltage of the sensing mode enable clock signal S_CLK, and, thus, the eighteenth transistor T18 may be turned on. That is, the scan signal SCAN[m], that is, a scan-on signal, having the active voltage of the third scan clock signal CLK3_SC may be output through the scan signal output node ON_SC. At this time, the remaining scan clock signals CLK1_SC, CLK2_SC, and CLK4_SC other than the third scan clock signal CLK3_SC may have inactive voltages, but exemplary embodiments are not limited thereto, and the remaining scan clock signals CLK1_SC, CLK2_SC, and CLK4_SC may have active voltages. Further, during at least a portion of the porch period, the first to fourth clock signals CLK1 to CLK4 may have active voltages or may be maintained in an inactive state.

In contrast, during the porch period of one frame, the fifteenth transistor T15 in each of the scan signal output circuits SSC1 to SSCm−1 and SSCm+1 to SSCn that do not store a sampling voltage is not turned on, and, thus, a sensing signal having the active voltage of the third sensing clock signal CLK3_SS and a scan signal having the active voltage of the third scan clock signal CLK3_SC will not be output.

Figure 8:
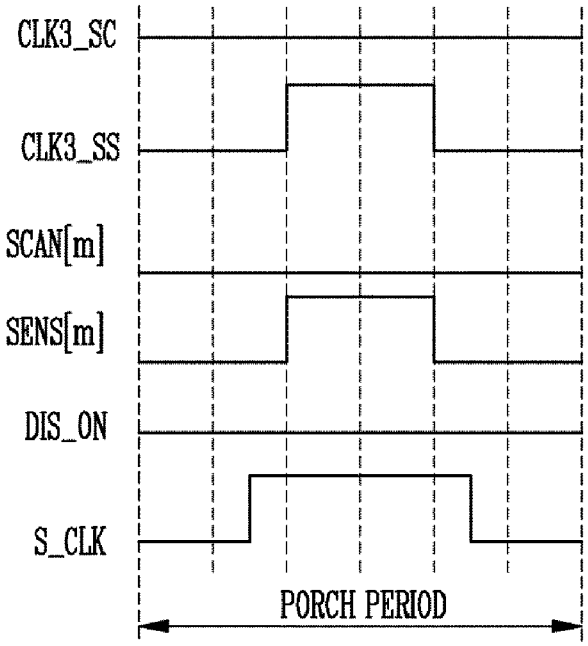
FIG. 8 is a waveform diagram for explaining an operation in which the scan signal output circuit generates a sensing signal for an operation of sensing deterioration of a light-emitting element according to some exemplary embodiments.

FIG. 8 is a waveform diagram for explaining an operation in which the scan signal output circuit generates a sensing signal for an operation of sensing deterioration of a light-emitting element according to some exemplary embodiments.

Referring to FIG. 8, during a porch period of one frame, the fifteenth transistor T15 in the scan signal output circuit SSCm, in which the sampling node SN holds the sampling voltage using the third capacitor C3, may be turned on by the sampling voltage.

If the sensing mode enable clock signal S_CLK is activated when the fifteenth transistor T15 is in a turned-on state, the first driving node Q1N may be charged to the active voltage of the sensing mode enable clock signal S_CLK.

Accordingly, the first driving signal Q1 applied to the first driving node Q1N may have the active voltage of the sensing mode enable clock signal S_CLK. As a result, the first transistor T1 may be turned on, and the sensing signal SENS[m] having the active voltage of the third sensing clock signal CLK3_SS, may be output through the sensing signal output node ON_SC. The remaining sensing clock signals CLK1_SS, CLK2_SS, and CLK4_SS other than the third sensing clock signal CLK3_SS may have inactive voltages, but exemplary embodiments are not limited thereto, and the remaining sensing clock signals CLK1_SS, CLK2_SS, and CLK4_SS may have active voltages.

Meanwhile, while the display-on signal DIS_ON is inactivated during the porch period, the twelfth transistor T12 and the thirteenth transistor T13 may be turned off, and the first driving node Q1N may be charged to the active voltage of the sensing mode enable clock signal S_CLK, and, thus, the eighteenth transistor T18 may be turned on. That is, the scan signal SCAN[m], that is, a scan-off signal, having the inactive voltage of the third scan clock signal CLK3_SC may be output through the scan signal output node ON_SC. At this, time, the remaining scan clock signals CLK1_SC, CLK2_SC, and CLK4_SC other than the third scan clock signal CLK3_SC may also have inactive voltages. Further, the first to fourth clock signals CLK1 to CLK4 may have active voltages or may be maintained in an inactive state during at least a portion of the porch period.

During the porch period of one frame, the fifteenth transistor T15 in each of the scan signal output circuits SSC1 to SSCm−1 and SSCm+1 to SSCn that do not store a sampling voltage is not turned on, and, thus, a sensing signal having the active voltage of the third sensing clock signal CLK3_SS will not be output.

Figure 9:
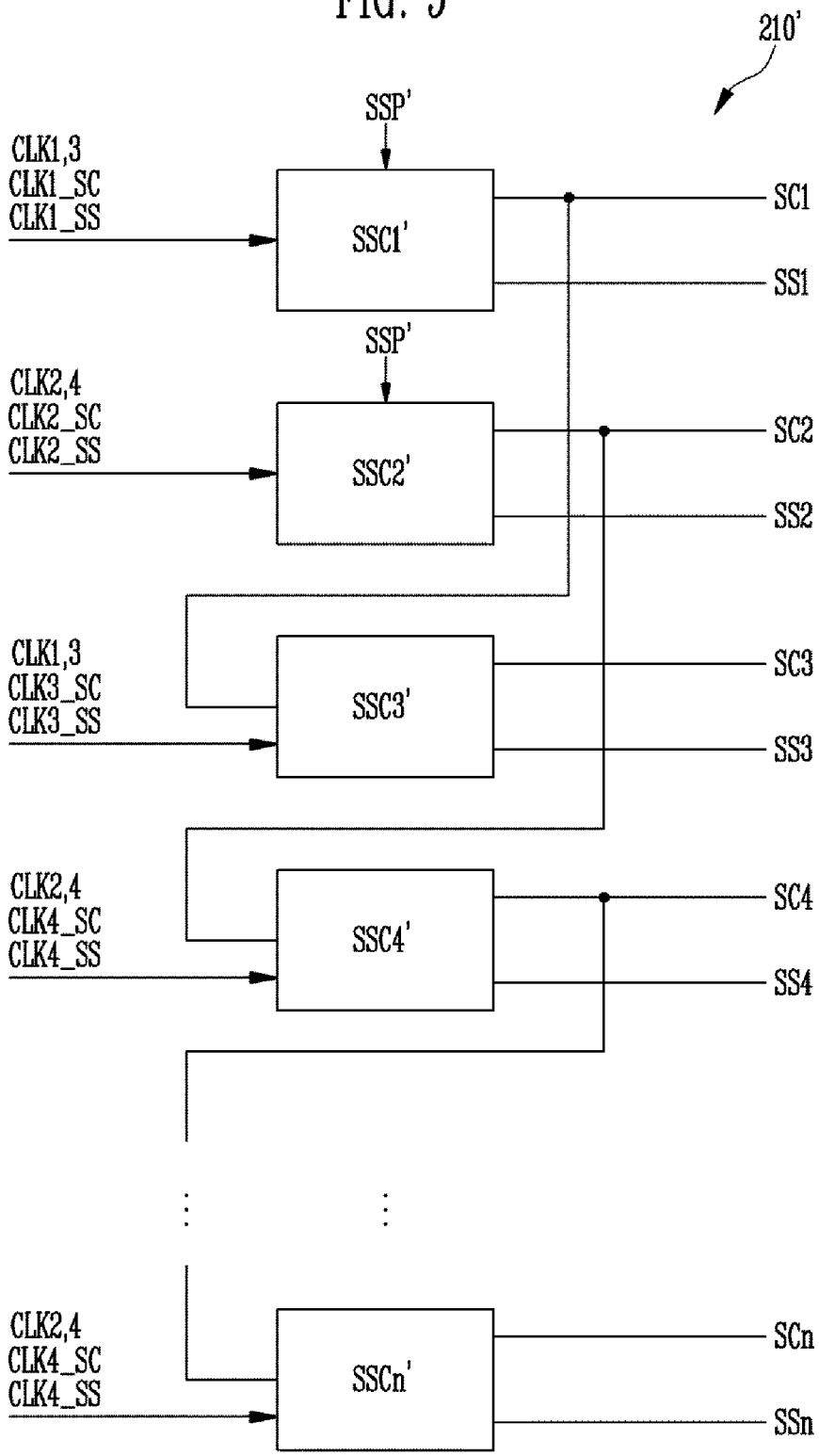
FIG. 9 is a block diagram illustrating the configuration of a scan driver according to some exemplary embodiments.

FIG. 9 is a diagram illustrating the configuration of a scan driver according to some exemplary embodiments. In FIG. 9, a description will mainly be made based on changed parts compared to the previously described exemplary embodiments, and descriptions of repeated parts will be primarily omitted. Accordingly, hereinafter, coupling relationships between scan signal output circuits SSC1' to SSCn' will be mainly described.

Referring to FIG. 9, a scan driver 210' may include a plurality of scan signal output circuits SSC1' to SSCn', and two or more of the scan signal output circuits SSC1' to SSCn' may be coupled to each other.

For example, the first scan signal output circuit SSC1' may receive a scan start signal SSP', and may be coupled to a first first scan line SC1 and a first second scan line SS1. The second scan signal output circuit SSC2' may receive the scan start signal SSP', and may be coupled to a second first scan line SC2 and a second second scan line SS2. The third scan signal output circuit SSC3' may be coupled to the first scan signal output circuit SSC1' to receive a scan signal output from the first scan signal output circuit SSC1', and may be coupled to a third first scan line SC3 and a third second scan line SS3. The fourth scan signal output circuit SSC4' may be coupled to the second scan signal output circuit SSC2' to receive a scan signal output from the second scan signal output circuit SSC2', and may be coupled to a fourth first scan line SC4 and a fourth second scan line SS4. The n-th scan signal output circuit SSCn' may be coupled to the (n−2)-th scan signal output circuit SSCn−2' to receive a scan signal output from the (n−2)-th scan signal output circuit SSCn−2', and may be coupled to an n-th first scan line SCn and an n-th second scan line SSn.

Figure 10:
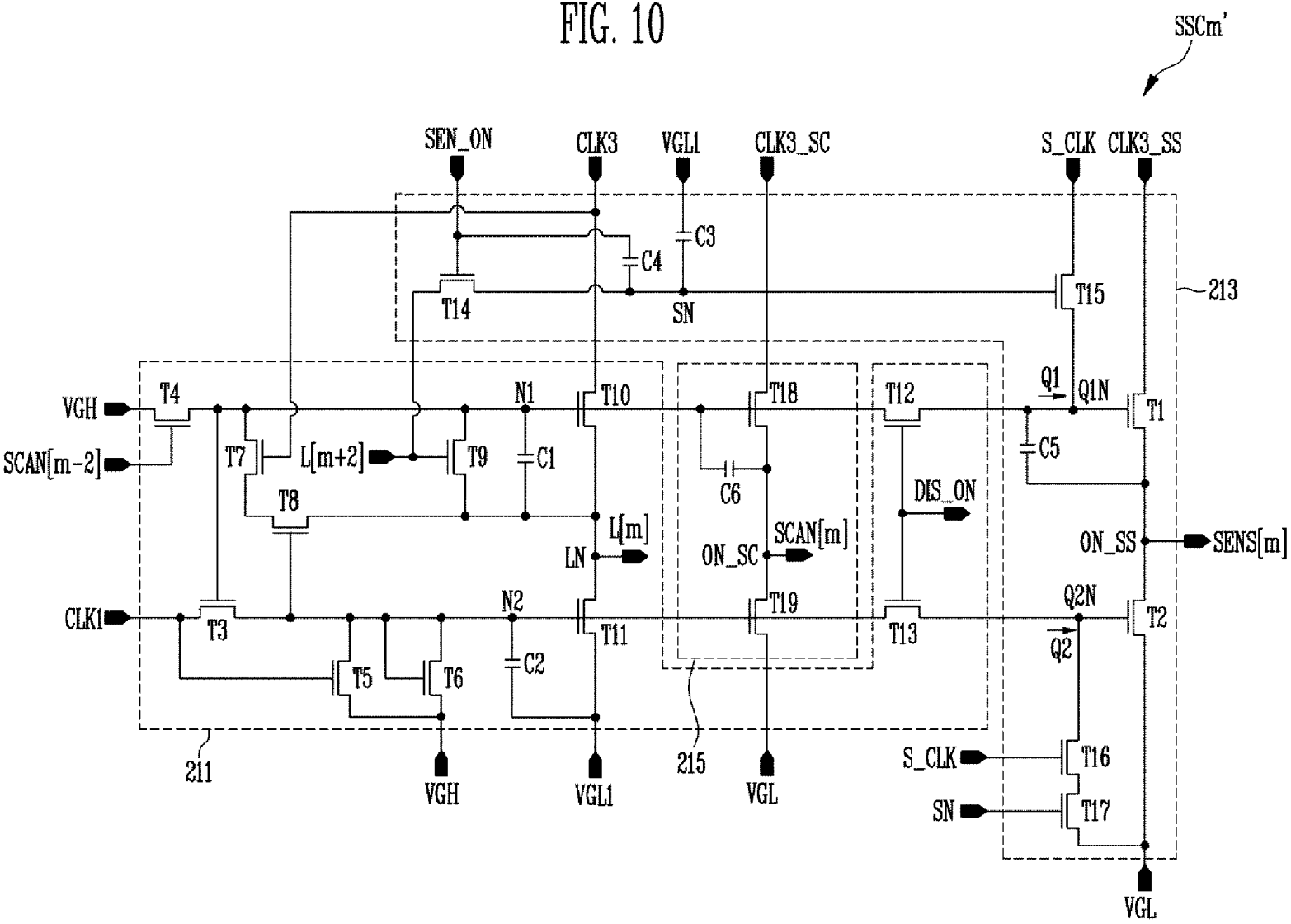
FIG. 10 is a diagram illustrating the configuration of any one of scan signal output circuits illustrated in FIG. 9 according to some exemplary embodiments.

FIG. 10 is a diagram illustrating the configuration of any one of the scan signal output circuits illustrated in FIG. 9 according to some exemplary embodiments. In FIG. 10, for convenience of description, the configuration of an m-th scan signal output circuit SSCm' is illustrated and will be described. Further, a description will be mainly made based on changed parts compared to the previously described exemplary embodiments, and descriptions of repeated parts will be primarily omitted.

Referring to FIG. 10, a fourth transistor T4 included in a driving circuit 211 may include a first electrode coupled to an on-level voltage VGH, a second electrode coupled to a first node N1, and a gate electrode configured to receive an (m−2)-th scan signal SCAN[m−2].

In a case where the (m−2)-th scan signal SCAN[m−2] is input to the gate electrode of the fourth transistor T4, a precharge period for a first driving node Q1N may be lengthened in a procedure for generating a scan signal for a display operation, compared to a case where an (m−1)-th scan signal SCAN[m−1] is input to the gate electrode of the fourth transistor T4.

Figure 11:
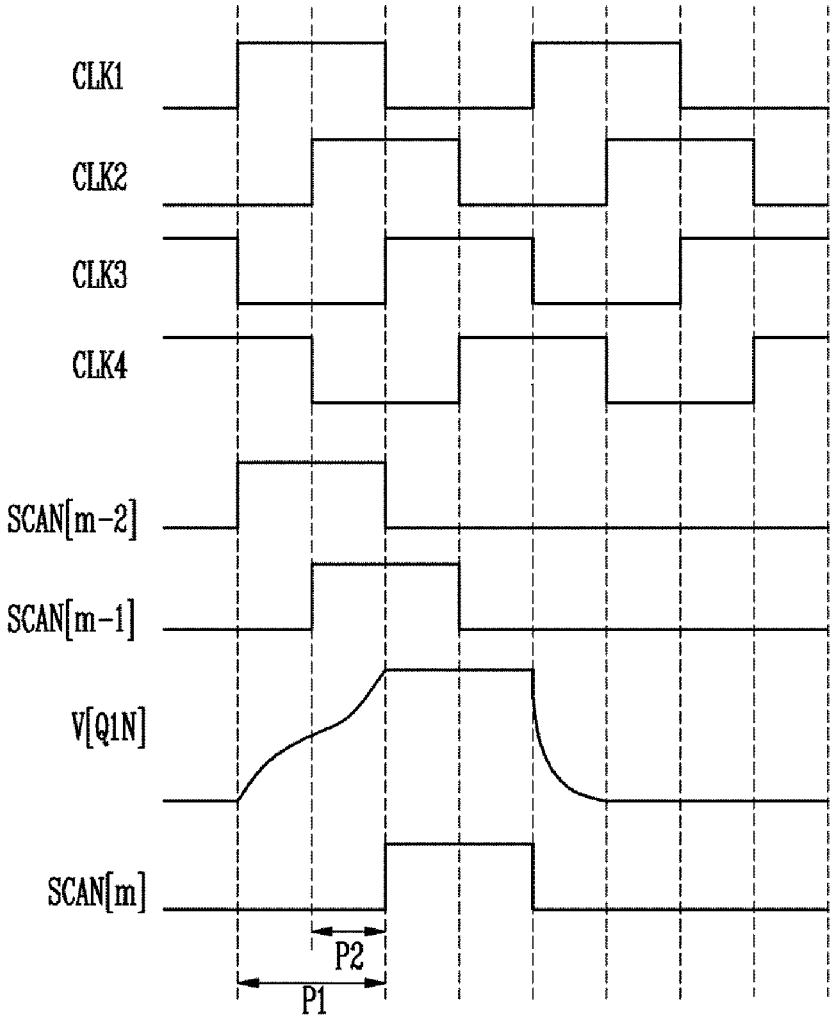
FIG. 11 is a waveform diagram for explaining a change in the potential of a first driving node Q1N illustrated in FIG. 10 according to some exemplary embodiments.

FIG. 11 is a waveform diagram for explaining a change in the potential of a first driving node Q1N illustrated in FIG. 10 according to some exemplary embodiments.

As described above, when an activated signal is input to the gate electrode of the fourth transistor T4, the first driving node Q1N starts to be charged to an on-level voltage VGH.

Therefore, as illustrated in FIG. 11, when an (m−2)-th scan signal SCAN[m−2] is input to the gate electrode of the fourth transistor T4, the first driving node Q1N may be precharged during a first period P1.

In contrast, when an (m−1)-th scan signal SCAN[m−1] is input to the gate electrode of the fourth transistor T4, the first driving node Q1N may be precharged during a second period P2 shorter than the first period P1. That is, in the case of the scan driver 210' according to some exemplary embodiments, a more accurate scan signal may be output by lengthening the precharge period of the first driving node Q1N.

As described above with reference to FIGS. 9 to 11, in accordance with some exemplary embodiments, not only the first scan signal output circuit SSC1, but also the second scan signal output circuit SSC2 may receive, as an input signal, the scan start signal SSP'. A period during which the scan start signal SSP' is activated may be set to a period longer than a period from a time point at which the first clock signal CLK1 starts to be activated (e.g., a time point corresponding to a rising edge of the first clock signal CLK1) to a time point at which the second clock signal CLK2 starts to be inactivated (e.g., a time point corresponding to a falling edge of the second clock signal CLK2).

According to various exemplary embodiments, a scan driver is provided that is capable of separating scan signals for supplying data signals from sensing signals for sensing mobility and deterioration of a light-emitting element and that is capable of separately outputting the scan signals and the sensing signals. As such, when a display device is in a powered-on state, mobility and deterioration of a light-emitting element may be accurately sensed.

Although certain exemplary embodiments and implementations have been described herein, other embodiments and modifications will be apparent from this description. Accordingly, the inventive concepts are not limited to such embodiments, but rather to the broader scope of the accompanying claims and various obvious modifications and equivalent arrangements as would be apparent to one of ordinary skill in the art.

What is claimed is:

1. A scan driver, comprising:

first to n-th ("n" being a natural number of two (2) or more) scan signal output circuits, each of the first to n-th scan signal output circuits being coupled to a first scan line and a second scan line, wherein each of the first to n-th scan signal output circuits comprises:

a driving circuit configured to apply a first driving signal to a first driving node and apply a second driving signal to a second driving node based on an input signal, a clock signal, a display-on signal, and an on-level voltage, the input signal being one of a scan start signal and a previous scan signal;

a first buffer circuit configured to output a sensing signal to the second scan line based on the first driving signal, the second driving signal, an off-level voltage, and a sensing clock signal; and a second buffer circuit configured to output a scan signal to the first scan line based on the first driving signal, the second driving signal, the off-level voltage, and a scan clock signal.

2. The scan driver according to claim 1, wherein:

one frame comprises a display period and a porch period; and each of the first to n-th scan signal output circuits is configured to output the scan signal via the first scan line during the display period.

3. The scan driver according to claim 2, wherein, during the porch period, at least one of the first to n-th scan signal output circuits is configured to output the sensing signal via the second scan line.

4. The scan driver according to claim 3, wherein, while the sensing signal is output via the second scan line coupled to at least one of the first to n-th scan signal output circuits, the scan signal is output via the first scan line.

5. The scan driver according to claim 3, wherein, while the sensing signal is output via the second scan line coupled to at least one of the first to n-th scan signal output circuits, a scan-off signal is output via the first scan line.

6. The scan driver according to claim 1, wherein:

the clock signal comprises first to fourth clock signals;

the scan clock signal comprises first to fourth scan clock signals; and the sensing clock signal comprises first to fourth sensing clock signals.

7. The scan driver according to claim 6, wherein each of the first to n-th scan signal output circuits is configured to receive at least two of the first to fourth clock signals, at least one of the first to fourth scan clock signals, and at least one of the first to fourth sensing clock signals.

8. The scan driver according to claim 7, wherein the driving circuit in an m-th ("m" being a natural number less than "n") scan signal output circuit comprises:

a third transistor comprising a first electrode configured to receive the first clock signal, a second electrode coupled to a second node, and a gate electrode coupled to a first node;

a fourth transistor comprising a first electrode configured to receive the on-level voltage, a second electrode coupled to the first node, and a gate electrode configured to receive the input signal;

a fifth transistor comprising a first electrode coupled to the second node, a second electrode configured to receive the on-level voltage, and a gate electrode configured to receive the first clock signal;

a sixth transistor comprising a first electrode coupled to the second node, a second electrode configured to receive the on-level voltage, and a gate electrode coupled to the second node;

a seventh transistor comprising a first electrode coupled to the first node, a second electrode, and a gate electrode configured to receive the third clock signal;

an eighth transistor comprising a first electrode coupled to the second electrode of the seventh transistor, a second electrode coupled to a carry signal output node, and a gate electrode coupled to the second node;

a ninth transistor comprising a first electrode coupled to the first node, a second electrode coupled to the carry signal output node, and a gate electrode configured to receive a next carry signal;

a first capacitor comprising a first electrode coupled to the first node and a second electrode coupled to the carry signal output node;

a tenth transistor comprising a first electrode configured to receive the third clock signal, a second electrode coupled to the carry signal output node, and a gate electrode coupled to the first node;

an eleventh transistor comprising a first electrode coupled to the carry signal output node, a second electrode configured to receive a sub-off-level voltage, and a gate electrode coupled to the second node, the sub-off level voltage being a lower voltage than the off-level voltage;

a second capacitor comprising a first electrode coupled to the second node and a second electrode configured to receive the sub-off-level voltage;

a twelfth transistor comprising a first electrode coupled to the first node, a second electrode coupled to the first driving node, and a gate electrode configured to receive the display-on signal; and a thirteenth transistor comprising a first electrode coupled to the second node, a second electrode coupled to the second driving node, and a gate electrode configured to receive the display-on signal.

9. The scan driver according to claim 8, wherein the gate electrode of the fourth transistor is configured to receive, as the input signal, either the scan signal output from an (m−1)-th scan signal output circuit or the scan start signal.

10. The scan driver according to claim 8, wherein the gate electrode of the fourth transistor is configured to receive, as the input signal, either the scan signal output from an (m−2)-th scan signal output circuit or the scan start signal.

11. The scan driver according to claim 8, wherein the first buffer circuit in the m-th scan signal output circuit comprises:

a fourteenth transistor comprising a first electrode configured to receive the next carry signal, a second electrode coupled to a sampling node, and a gate electrode configured to receive a sensing-on signal;

a third capacitor comprising a first electrode coupled to the sampling node and a second electrode configured to receive the sub-off-level voltage;

a fifteenth transistor comprising a first electrode configured to receive a sensing mode enable clock signal, a second electrode coupled to the first driving node, and a gate electrode coupled to the sampling node;

a sixteenth transistor comprising a first electrode coupled to the second driving node, a second electrode, and a gate electrode configured to receive the sensing mode enable clock signal;

a seventeenth transistor comprising a first electrode coupled to the second electrode of the sixteenth transistor, a second electrode configured to receive the off-level voltage, and a gate electrode coupled to the sampling node;

a first transistor comprising a first electrode configured to receive a third sensing clock signal, a second electrode coupled to a sensing signal output node, and a gate electrode coupled to the first driving node;

a fourth capacitor comprising a first electrode coupled to the sampling node and a second electrode coupled to the gate electrode of the fourteenth transistor configured to receive the sensing-on signal;

a fifth capacitor comprising a first electrode coupled to the first driving node and a second electrode coupled to the sensing signal output node; and a second transistor comprising a first electrode coupled to the sensing signal output node, a second electrode configured to receive the off-level voltage, and a gate electrode coupled to the second driving node.

12. The scan driver according to claim 11, wherein the second buffer circuit in the m-th scan signal output circuit comprises:

an eighteenth transistor comprising a first electrode configured to receive a third scan clock signal, a second electrode coupled to a scan signal output node, and a gate electrode coupled to the first node;

a sixth capacitor comprising a first electrode coupled to the first node and a second electrode coupled to the scan signal output node; and a nineteenth transistor comprising a first electrode coupled to the scan signal output node, a second electrode configured to receive the off-level voltage, and a gate electrode coupled to the second node.

13. The scan driver according to claim 12, wherein:

the scan signal output node is coupled to the first scan line; and the sensing signal output node is coupled to the second scan line.

14. The scan driver according to claim 12, wherein:

one frame comprises a display period and a porch period;

during the porch period, the display-on signal is inactivated, and the sensing mode enable clock signal, the third scan clock signal, and the third sensing clock signal are activated.

15. The scan driver according to claim 12, wherein:

one frame comprises a display period and a porch period; and during the porch period, the display-on signal and the third scan clock signal are inactivated, and the sensing mode enable clock signal and the third sensing clock signal are activated.

16. The scan driver according to claim 12, wherein:

one frame comprises a display period and a porch period; and during the display period, the display-on signal, the first and third clock signals, and the third scan clock signal are activated, and the sensing mode enable clock signal and the third sensing clock signal are inactivated.

17. The scan driver according to claim 16, wherein, during an active interval of the next carry signal within the display period, the sensing-on signal is activated or inactivated.

18. A display device, comprising:

a display unit comprising pixels;

a data driver configured to supply a data signal to the display unit;

a scan driver configured to supply a scan signal and a sensing signal to the display unit; and a timing controller configured to control the data driver and the scan driver, wherein the scan driver comprises first to n-th ("n" being is a natural number of two (2) or more) scan signal output circuits, each of the first to n-th scan signal output circuits being coupled to a first scan line and a second scan line, wherein each of the first to n-th scan signal output circuits comprises:

a driving circuit configured to apply a first driving signal to a first driving node and apply a second driving signal to a second driving node based on an input signal, a clock signal, a display-on signal, and an on-level voltage, the input signal being one of a scan start signal and a previous scan signal;

a first buffer circuit configured to output the sensing signal to the second scan line based on the first driving signal, the second driving signal, an off-level voltage, and a sensing clock signal; and a second buffer circuit configured to output the scan signal to the first scan line based on the first driving signal, the second driving signal, the off-level voltage, and a scan clock signal.

19. The display device according to claim 18, wherein:

one frame comprises a display period and a porch period; and during the porch period, the display device is configured to perform an operation of sensing at least one of mobility of a driving transistor in at least one of the pixels and deterioration of a light-emitting element in at least one of the pixels.

20. The display device according to claim 19, wherein, during the display period, each of the first to n-th scan signal output circuits is configured to output the scan signal via the first scan line.

21. The display device according to claim 19, wherein, during the porch period, at least one of the first to n-th scan signal output circuits is configured to output the sensing signal via the second scan line.

22. The display device according to claim 19, wherein each of the pixels comprises:

a light-emitting element;

a driving transistor configured to control an amount of current flow through the light-emitting element in response to the data signal;

a switching transistor comprising a gate electrode coupled to the first scan line and being configured to receive the data signal; and a sensing transistor comprising a gate electrode coupled to the second scan line, the sensing transistor being coupled to a first electrode of the light-emitting element.

23. The display device according to claim 22, wherein, as part of the operation of sensing mobility of the driving transistor, the scan signal is supplied through the first scan line, and the sensing signal is supplied through the second scan line.

24. The display device according to claim 22, wherein, as part of the operation of sensing deterioration of the light-emitting element, a scan-off signal is supplied through the first scan line, and the sensing signal is supplied through the second scan line.

25. The display device according to claim 18, wherein the timing controller is configured to supply the clock signal comprising first to fourth clock signals, the scan clock signal comprising first to fourth scan clock signals, and the sensing clock signal comprising first to fourth sensing clock signals to the scan driver.

26. The display device according to claim 25, wherein each of the first to n-th scan signal output circuits is configured to receive at least two of the first to fourth clock signals, at least one of the first to fourth scan clock signals, and at least one of the first to fourth sensing clock signals.

* * * * *